United States Patent [19]

Myller

[11] Patent Number: 4,964,834

[45] Date of Patent: Oct. 23, 1990

[54] TRIANGLE BASED INTERCONNECTING BLOCK SET

[76] Inventor: Rolf Myller, 1165 Fifth Ave., New York, N.Y. 10029

[21] Appl. No.: 11,027

[22] Filed: Feb. 5, 1987

[51] Int. Cl.[5] ..... A63H 33/08

[52] U.S. Cl. ..... 446/118; 446/128

[58] Field of Search ..... 446/115, 116, 117, 120, 446/124, 125, 128, 112, 126, 118; 52/574, 575, 594; 434/195, 196, 205; D21/108

[56] References Cited

U.S. PATENT DOCUMENTS

| | | | |
|---|---|---|---|
| 3,094,792 | 6/1963 | Morgan et al. | 434/195 |
| 3,248,804 | 5/1966 | Jorgens | 434/195 |
| 3,487,579 | 1/1970 | Brettingen | 52/594 |
| 3,766,667 | 10/1973 | Glassman | 434/195 |
| 3,996,675 | 12/1976 | Placek | 434/196 |
| 4,026,087 | 5/1977 | White | 446/125 |
| 4,183,167 | 1/1980 | Jatich | 446/118 |
| 4,606,732 | 8/1986 | Lyman | 446/120 |

FOREIGN PATENT DOCUMENTS

| | | | |
|---|---|---|---|
| 128398 | 4/1948 | Australia | 446/128 |
| 2250131 | 4/1974 | Fed. Rep. of Germany | 446/120 |
| 1678326 | 6/1979 | Fed. Rep. of Germany | 446/124 |
| 1264926 | 5/1961 | France | 446/128 |
| 935308 | 8/1963 | United Kingdom | 446/128 |
| 976761 | 12/1964 | United Kingdom | 446/128 |

*Primary Examiner*—Mickey Yu

*Attorney, Agent, or Firm*—Lane, Aitken & McCann

[57] ABSTRACT

In a set of interconnecting blocks, each provided with a male top side designed to interconnect with a female bottom side, the blocks are shaped in the form of equilateral triangles or combinations of equilateral triangles such as parallelograms, trapezoids, and hexagons. Studs are provided on the male sides of the blocks which mate with triangular openings on the female sides of the blocks and when the blocks are interconnected, they are frictionally held together. The set includes a transitional module to interconnect with square based blocks of the prior art.

12 Claims, 2 Drawing Sheets

TRIANGLE BASED INTERCONNECTING BLOCK SET

This invention relates to building block toys and more particularly to a building block toy of the type employing cooperating studs and recesses on opposite sides of block so that the blocks of the toy may be frictionally held in engagement.

BACKGROUND OF THE INVENTION

A well known building block toy comprises rectangular pieces made of synthetic resin and having round studs on one side and a recess on the other side shaped so that the studs on one side of a given block may be inserted and frictionally held in the recess on the opposite side of another block. The most well known brand of such building block toys is LEGO. In the building block toy of the prior art described above, the studs are arranged in a basic square pattern and, as a result, the blocks lend themselves readily to being built into rectilinear shapes having right-angled corners.

SUMMARY OF THE INVENTION

The present invention is an improvement over the above described building block toy wherein the blocks are based on a equilateral triangle as the basic unit instead of an square. The building blocks have studs arranged in triangular patterns on one side of each block and recesses are formed on the other side to receive and frictionally engage the triangularly patterned studs on the opposite side so that the blocks may be built into structures in a manner similar to the prior art building block toy. Because the building block toy of the present invention is based on a triangle instead of a rectangle, the blocks of the toy readily lend themselves to being combined into shapes having 120 degree or 60 degree corners, while at the same time, they can be combined into rectilinear forms. By making one side of some of the blocks in the form of an arc centered at the opposite apex of the equilateral triangle, it is possible to combine such pieces into circular cylindrical shapes.

By providing adapter pieces as part cf the set of blocks, the triangle based pieces may also be combined with the square based pieces of the prior art described above. Thus, the building block of the present invention provides more versatility and variation in the shapes into which the blocks can be built thus stimulating greater creativity on the part of the child playing with the blocks.

Further advantages of the present invention will become readily apparent as the following detailed description of the invention unfolds when taken in conjunction with the following drawings.

DESCRIPTION OF A PREFERRED EMBODIMENT

Figure 1:
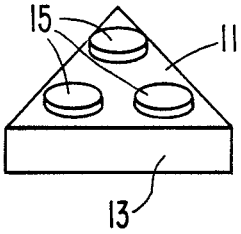
FIG. 1 is a perspective view of the basic triangular building block of the present invention.

As shown in FIG. 1, the basic building block of the invention is in the shape of a equilateral triangle having a planar top wall 11 in the form of an equilateral triangle on the male side of the block and three rectangular side walls 13. The height of the side walls preferably is between one-third and one-fourth the length, which also is the length of the side of the triangular top wall 11.

Three short round cylindrical studs 15 are formed on the top wall 11, each of the studs being centered on the vertices of an equilateral triangle which is centered in the equilateral triangle of the top wall 11. The studs 15 are positioned adjacent to the edges of the top wall 11 spaced a short distance therefrom.

Figure 2:
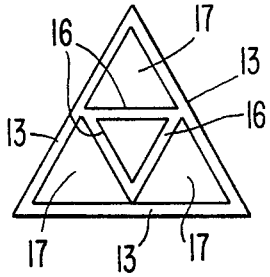
FIG. 2 is a bottom plan view of the building block of FIG. 1.

As shown in FIG. 2, the bottom or female side of the block of FIG. 1 is open to the top wall 11, but is provided with additional cross walls 16 extending between the middle points of the side walls 13. The cross walls 16 define with the side walls 13 three triangular cavities 17. The cylindrical studs 15 are selected to be of a size so that they may be inserted into the cavities 17 of another identical block of the set and frictionally engage the walls 13 and 16 so that when the studs 15 of one block have been inserted into the cavities 17 of another block, the blocks will be frictionally held in engagement. Thus, it will be apparent that the distance between the studs 15 and the edge of the top 11 should be slightly less than the thickness of the wall 13. The walls 16 should be positioned so that the cavities 17 are equilateral triangles so that the studs 15 will frictionally engage all three sides of the cavities 17. Instead of using cross walls 16, the center of the block may be made into a solid triangle so as to still define the cavities 17 in the form of equilateral triangles. Also, the triangular center designed by the walls 16 does not have to extend to the side walls. As a further alternative, the center may be cylindrical as it is in the prior art square based pieces.

Figure 3:
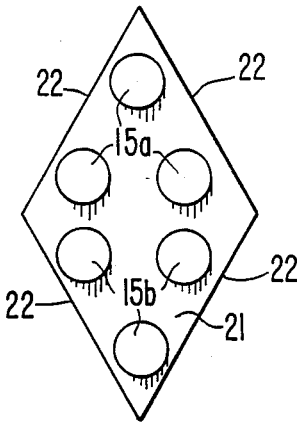
FIG. 3 is a top plan view of a building block forming part of the set of the building blocks of the invention in which two of the basic triangular shapes are combined into a single block.
Figure 4:
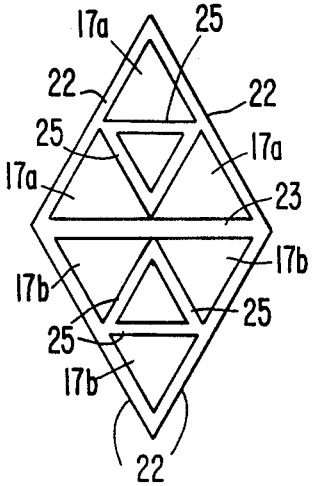
FIG. 4 is a bottom plan view of the block of FIG. 3.

The block of the invention shown in FIGS. 3 and 4 is in the form of two of the blocks of FIGS. 1 and 2 put together with the triangles base to base. Accordingly, it comprises a top wall 21 in the form of a parallelogram having 60 degree and 120 degree vertices and rectangular side walls 22 identical in size and shape to the side walls 13 of the block of FIG. 1. Two sets of three round cylindrical studs 15and 15*b* having the same size as the studs in the block of Figure are formed on the top wall 21. Each set of studs 15*a* and 15*b* is arranged relative to the corresponding triangular half of the top wall 21 in the same manner as the studs 15 are arranged on the top wall 11 of the block of FIG. 1. The bottom or female side of the block of FIGS. 3 and 4, as shown in FIG. 4, is open to the top wall 21 and is divided into two equilateral triangular portions by a cross wall 23 extending between the 120 degree vertices of the parallelogram. The wall 23 has a thickness twice the thickness of the side walls 13. Cross walls 25 extend between the middle of the cross wall 23 and the side wall 22 also between the middle of adjacent side walls 22 joined at the 60 degree vertices. The cross walls 25 define two sets of three cavities 17*a* and 17*b*. Each set 17*a* and 17*b* corresponds identically in size, shape and arrangement TM to the set of cavities 17 in the block of FIG. 1. Accordingly, the block of FIG. 1 can be mounted on the block of FIG. 4 and vice versa, by inserting the studs 15*a* or the studs 15*b* into the cavities 17, or by inserting the studs 15 into the cavities 17*a* or 17*b*. Blocks like the one shown in FIGS. 3 and 4 can be mounted directly on top of one another or they may be overlapped to form a two-tiered hexagon or a rectilinear structure of indefinite length. It is apparent that a very large number of variations of interconnecting blocks of FIGS. 3 and 4 or both the blocks of FIGS. 1 and 2 and FIGS. 3 and 4 can be created.

Figure 5:
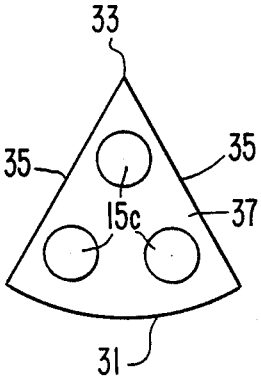
FIG. 5 is a top plan view of a pie shaped building block of the set of the present invention having an arcuate edge.
Figure 6:
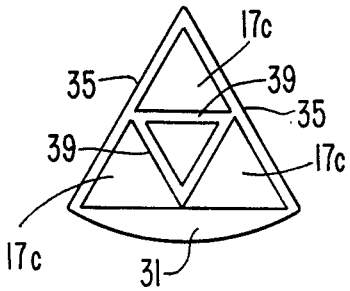
FIG. 6 is a bottom plan view of the building block of FIG. 5.

The block of FIGS. 5 and 6 is similar to the block of FIGS. 1 and 2 except that this block has a side wall 31 having an outer surface in the form of a section of a circular cylinder centered about the opposite vertex 33 of the block. The remaining two side walls 35 of the block of FIGS. 5 and 6 are identical in size and shape to the side walls 13 of the block of FIG. 1. The block of FIGS. 5 and 6, accordingly, will have a pie shaped top wall 37. Round cylindrical studs 15chaving the same size and shape as the studs 15 are formed on the top wall 37 and are arranged on the top wall 37 in the same position relative to the walls 35 and the apex 33 that the studs 15 are arranged on a top wall 11 relative to the side walls 13. As shown in FIG. 6, the inner surface of the side wall 31 is planar so that the side wall 31 is thickened by the cylindrical shape of the outer surface thereof. The side walls 31 and 35 define a triangular opening in the female side of the block extending to the top wall 37 and the inner surface of the side wall 31 is located so that this triangular opening is the same size as the triangular opening defined by the side walls 13 in the block of FIG. 1. Cross walls 39 extend between the middle of the side walls 35 and 31 to define three triangular cavities 17*c* which are of identical size, shape and arrangement to the cavities 17 in the block of FIGS. 1 and 2. As a result, the blocks of FIGS. 5 and 6 may be mounted on each other and interconnected with the blocks of FIGS. 1 and 2 and 3 and 4. By interconnecting the blocks of FIGS. 5 and 6 by means of blocks shown in FIGS. 3 and 4, for example, in a set of six blocks having their vertices 33 at the center, the blocks of FIGS. 5 and 6 can be formed into a wheel.

Figure 7:
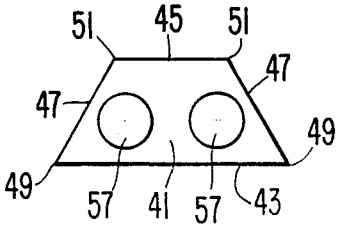
FIG. 7 is a top plan view of a truncated building block of the set of the present invention.
Figure 8:
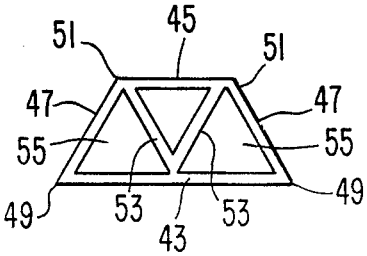
FIG. 8 is a bottom plan view of the building block of FIG. 7.

The block of FIGS. 7 and 8 is trapezoidal in shape having a top wall 41 in the shape of a trapezoid. The trapezoid shape of the block of FIGS. 7 and 8 corresponds to the triangular shape of the block of FIGS. 1 and 2 which triangular shape has been truncated. The block has a long side wall 43 which is identical in size and shape to the side walls 13 of the block of FIGS. 1 and 2, a second side wall 45 parallel to the side wall 43 and two side walls 47 which have lengths half the length of the side wall 43. The trapezoidal shape of the block has two 60 degree vertices 49 and two, 120 degree vertices 51. The female side of the block is open so that the side walls 43, 47 and 45 define a trapezoidal opening extending to the top wall 41. Within this opening, cross walls 53 extend between the vertices 51 and the middle of the side wall 43 to define two triangular cavities 55. The triangular cavities 55 have the same size, shape and arrangement as two of the cavities 17 in the block of FIG. 1, so that any two of the studs 15, 15*a*, 15*b* or 15*c* may be inserted into and frictionally held in the triangular cavities 55. On the top wall 41, are two round cylindrical studs 57 which have the same size and shape and arrangement as any two of the studs 15 in the block of FIG. 1 so that these studs may be inserted into corresponding cavities in another trapezoidal block or any other block of the set as shown in FIGS. 1–6.

Figure 9:
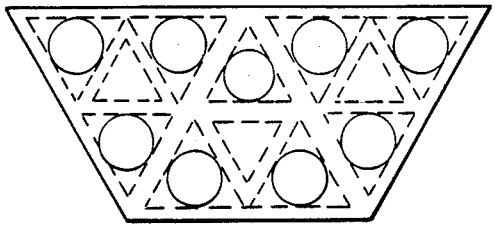
FIG. 9 is a top plan view of a trapezoidal block of the block set corresponding to three triangular pieces shown in FIGS. 1 and 2 put together.

FIG. 9 illustrates a top plan view of a trapezoidal shaped block which corresponds to three of the triangular blocks of FIGS. 1 and 2 put together to make the trapezoid of FIG. 9 in the same manner that two triangular blocks of FIG. 1 are put together to make the parallelogrammic block of FIGS. 3 and 4. Thus, the male or female side can be interconnected with any of the female or male sides respectively of any of the blocks shown in FIGS. 1 through 8. The walls which define the triangular cavities in the female side of the block are shown in phantom in FIG. 9.

Figure 10:
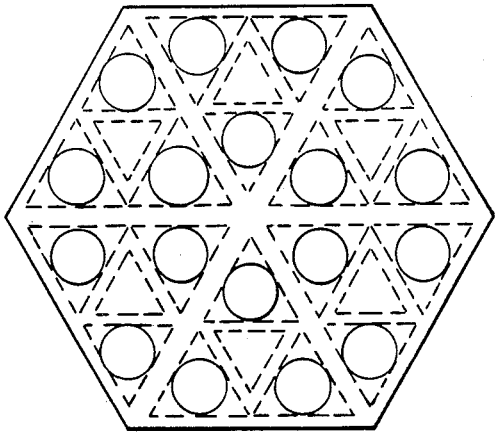
FIG. 10 illustrates a top plan view of a hexagonal piece of the block set corresponding to six triangular pieces of FIG. 1 put together.

The hexagonal piece shown in FIG. 10 is the same size as six of the triangular pieces of FIGS. 1 and 2 put together. Within each of the six triangular parts of the hexagon there are positioned a set of three studs. Each set of studs are the same size of the studs of the piece in FIG. 1 and are arranged on the corresponding triangular part of the piece of FIG. 10 in the same manner that the studs are arranged on the top wall of the triangular piece of FIG. 1. The wall structure of the female side of FIG. 10 corresponds to the previously described pieces and is shown in phantom in FIG. 10. It will be apparent that any of the pieces of FIGS. 1 through 9 can be interconnected in various configurations with the piece of FIG. 10.

Figure 11:
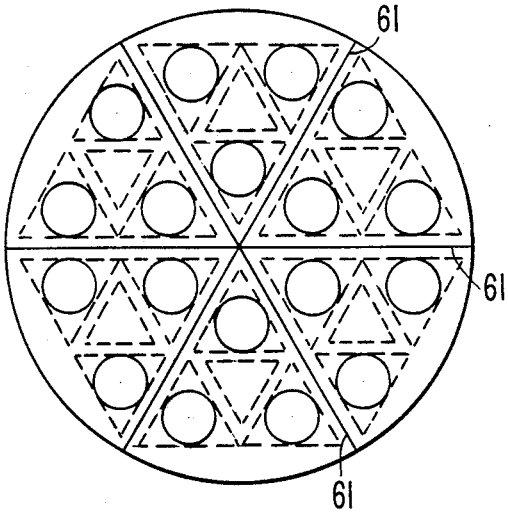
FIG. 11 is a top plan view of a round element corresponding to six pie shaped elements of FIG. 5 and 6 put together.

FIG. 11 is a top plan view of a circular cylindrical piece corresponding to six pieces of FIGS. 5 and 6 put together. Visible scorelines 61 are formed on the top wall of the piece of FIG. 11 to divide it into its six pie shaped parts. Within each pie shaped part there are positioned a set of three studs. Each set of studs are the same size of the studs of the piece in FIG. 1 and are arranged on the corresponding pie shaped part of the piece of FIG. 11 in the same manner that the studs are arranged on the top wall of the pie shaped piece of FIGS. 5 and 6. The female side of the piece of FIG. 11 corresponds to that of the previously described pieces and is shown in phantom in FIG. 11. The scoreline's 61 serve as guides to assist in orienting other pieces when interconnecting them with the piece of FIG. 11.

Figure 12:
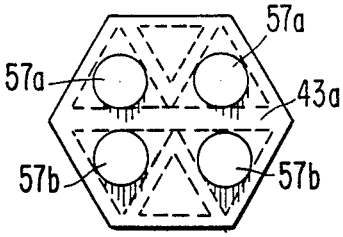
FIG. 12 is a top plan view of a small hexagonal piece of the block set of the invention.

FIG. 12 is a top plan view of a small hexagonal piece corresponding to two hexagonal pieces such as shown in FIGS. 7 and 8 put together. Accordingly, the piece of FIG. 12 is made up of two trapezoidal parts and on each trapezoidal parts is a pair of studs 57*a* and 57*b*. Each pair of studs 57*a* and 57*b* are shaped and arranged with respect to the trapezoidal portion on which they are positioned identically to the studs 57 on the top wall 41. The female side of the piece shown in FIG. 12 corresponds to the wall structure that would result from two pieces of FIGS. 7 and 8 joined together with the walls 43 merged into a center cross wall 43*a* as shown in phantom in FIG. 12 having a thickness twice that of the thickness of the walls 43. The remaining wall structure of the female side corresponds to that shown in FIG. 8 and is also shown in phantom in FIG. 12.

Figure 13:
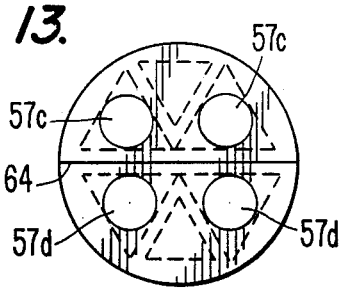
FIG. 13 is a top plan view of a small round piece of the block set of the invention.

FIG. 13 is a top plan view of a small circular cylindrical piece which is similar to the piece of FIG. 12 except that the side surfaces have been formed into a circular cylinder. A visible scoreline 64 is formed on the top surface of the piece of FIG. 13 to divide it into two semicircular parts. On each semicircular part, a pair of studs 57*c* and 57*d* are mounted shaped and arranged like the studs 57*a* and 57*b* on the piece of FIG. 12. The female side of the piece of FIG. 13 is provided with a wall structure shown in phantom, to define cavities in the shape of equilateral triangles, like the wall structure of the piece of FIG. 12, so as to be able to receive and fit with a set of four studs 57*a* and 57*b* or a second piece like the piece shown in FIG. 13. It will be apparent that the pieces of FIGS. 12 and 13 may be interconnected in various different configurations with any of the pieces shown in FIGS. 1 through 11. The scoreline 64 acts as a guide to indicate how to orient the other pieces when interconnecting them with the piece of FIG. 13.

Figure 14:
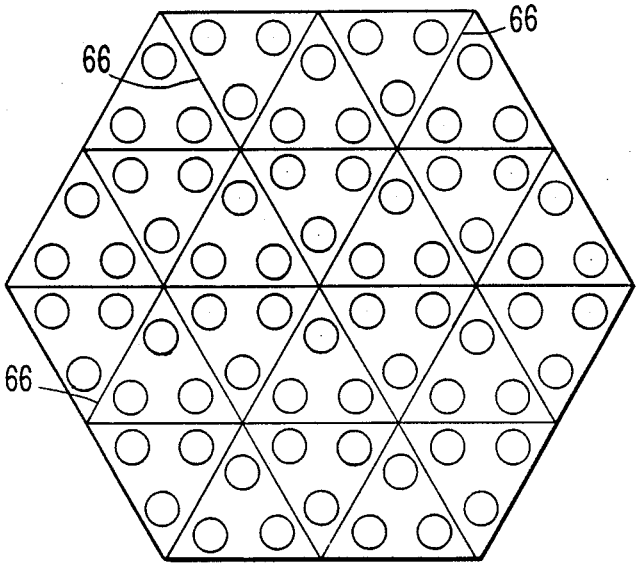
FIG. 14 is a top plan view of a large hexagonal base piece for the set of blocks of the invention.

The large hexagonal piece shown in top plan view in FIG. 14 in the preferred embodiment need not have a female side. The size of the piece shown in FIG. 14 is the same size in plan view as 24 triangular pieces of FIG. 1 put together although it can be larger and be different in shape. Scorelines 66 divide the hexagon into its 24 triangular parts. and within each triangular part is a set of three studs. Each set of studs are the same size as the studs 17 of the piece in FIG. 1 and are arranged on the corresponding triangular part of the piece of FIG. 14 in the same manner that the studs 17 are arranged on the top wall of the triangular piece of FIG. 1. The piece of FIG. 14 is intended to serve as a base on which to mount other pieces. The scorelines 66 provide an indication of how to orient the other pieces when mounting them on the base piece of FIG. 14.

Figure 15:
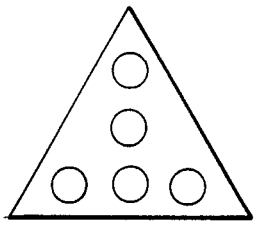
FIG. 15 is a top plan view of a transition piece designed to interconnect the blocks of the set of the invention with square based pieces.

The block of FIG. 15 is a transition module designed to interconnect blocks of the set cf FIGS. 1 through 14 with blocks of the prior art based on a square, such as the well known LEGO brand blocks. The specific embodiment of the transition module shown in FIG. 15 is triangular in plan view and is the same as the piece of FIGS. 1 and 2 except for the studs on the top wall. Instead of the three studs 15, the transition piece of FIG. 15 has a set of five studs 65 arranged in a T-configuration. The studs 65 have the same size and shape as the studs on the blocks of the square based set of the prior art and are arranged to fit with the female side of the blocks of the square based set. Thus, by means of pieces such as shown in FIG. 15, blocks of the square based set may be mounted on the blocks of the triangular based set of the invention.

Alternatively, the transition module may comprise a a parallelogrammic element similar to that shown in FIGS. 3 and 4 or a trapezoidal element as shown in FIG. 9. Also, the female side and the male side may be interchanged in the transition module so that the male side fits with the triangular based elements of the present invention and the female side fits with the square based set of the prior art.

A significant feature of most of the blocks of the set of the present invention is that the outer side surface of most of the blocks includes at least two planar sections which lie in planes that intersect at 60 degree angles. This feature enables the blocks to have these side surfaces abutted to create diverse structures in interconnected blocks. Another important feature is that the pattern of studs on the male side of the blocks and the cavities on the female side are positioned and arranged so that when two blocks are interconnected, the planar side surfaces of the interconnected blocks lie in planes parallel to a set of planes arranged at 60 degree angles to one another. This feature facilitates interconnecting the blocks into a common structure. A final feature to be noted is that most of the blocks in the preferred embodiment have a side surface in the form of a cylinder in the broad sense in that it is defined by a straight line moving parallel to a fixed straight line.

The preferred embodiment of the present invention comprises a set of blocks including a plurality of each of the different types of blocks or elements shown in FIGS. 1–13 and 15 and at least one element as shown in FIG. 14. It will be apparent that the set of blocks of the invention may exclude one or more of the different types of the blocks disclosed and may include additional further types of blocks not specifically disclosed, but which would interconnect with the disclosed blocks. It will also be apparent that an entertaining and stimulative set of blocks may be made entirely of the blocks like that shown in FIGS. 3 and 4. The blocks of the preferred embodiment have a top wall in one plane designed to interconnect with the recesses in another block so that the interconnected blocks have parallel top walls. This feature results from the fact that the entrances of the triangular cavities designed to receive the cylindrical studs lie in planes which are parallel to the top wall of the block. Instead of this arrangement, the blocks may be formed in varied three-dimensional shapes in which this parallel arrangement is not maintained. Further modifications of the invention may be made without departing from the spirit and scope of the invention, which is defined in the appended claims.

What is claimed is:

1. A block set comprising a plurality of blocks each having a top side, a bottom side and a side surface extending between said top and bottom side, at least one projecting means extending from the top side of each of said blocks and receiving means on the bottom side of each of said blocks to receive a projecting means extending from the top side of another one of said blocks to interconnect and hold together a pair of said blocks in predetermined alignments, a subset of blocks each having the shape of a geometric figure consisting of a plurality of contiguous, congruent, equilateral triangles when viewed in a sectional plane perpendicular to said side surface, said projecting means and said receiving means being arranged so that the blocks of said subset can be interconnected with only one of the contiguous equilateral triangles in each block of an interconnected pair of blocks, overlapping and held in fixed alignment by said projecting means and said receiving means.

2. A set of blocks as recited in claim 1, wherein a second subset of said blocks each have the shape of an equilateral triangle when viewed in a sectional plane perpendicular to the side surface of such block, the equilateral triangles of said second subset being congruent to the equilateral triangles of said first subset.

3. A set of blocks as recited in claim 1, wherein some of said blocks of said subset each have the shape of a parallelograph when viewed in said sectional plane.

4. A set of blocks as recited in claim 1, wherein each of the blocks of said subset has at least two projecting means on the top side thereof, each projecting means being on axes extending between said top and bottom sides and located in a different one of said contiguous triangles, and wherein the bottom side of each of the blocks of said subset has a first means to receive a projecting means on a second block of said plurality to interconnect and hold together with said second block and a second means to receive a projecting means on a third block of said plurality to interconnected and hold together with said third block in a different location than said first means holds together with said second block.

5. A set of blocks as recited in claim 1, wherein some of the blocks of said plurality have a curved side surface section extending between said top and bottom sides.

6. A set of blocks as recited in claim 1, wherein said projecting means consists of three studs positioned equally distant from one another.

7. A set of blocks as recited in claim 6, wherein said means to receive a projecting means on the bottom side of the block comprises means defining three triangular cavities to severally receive the three studs of the set of studs.

8. A set of blocks as recited in claim 7, wherein said side surface comprises the exterior surface of the sidewalls of the block and wherein said triangular cavities are defined by the inside surfaces of said sidewalls and by cross walls within said block.

9. A set of blocks as recited in claim 1, wherein some of said blocks of said subset have the shape of a trapezoid when viewed in said sectional plane.

10. A set of blocks as recited in claim 1, further comprising a base block having projecting means on the top surface thereof to be interconnectable with the blocks of said plurality and visible scorelines on the top side thereof to guide the orientation of other blocks when being interconnected with the top side of said base block having said scorelines.

11. A set of blocks as recited in claim 1, further comprising a base block having projecting means on the top surface thereof to be interconnectable with the blocks of said plurality and a plurality of visible scorelines on the top surface thereof distributed at angles of 60 degrees and serving to guide the interconnection of other blocks with the top surface of said base block.

12. A block set comprising a first set of blocks interconnected in either of two angular orientations displaced 90 degrees from each other, a second set of blocks interconnectable in any of three angular orientations displaced 60 degrees from each other, the blocks of said first set not being directly interconnectable with the blocks of said second set, a transition module block having a male side comprising a set of studs and a female side comprising a shaped aperture, the set of studs being shaped and arranged to interconnect with the blocks of one of said first and second sets and said shaped aperture being shaped and arranged to interconnect with the blocks of the other one of said first and second sets.

* * * * *